US006406643B2

(12) United States Patent
Lindén et al.

(10) Patent No.: US 6,406,643 B2
(45) **Date of Patent: *Jun. 18, 2002**

(54) HYDRAULIC OIL BASED ON ESTERS OF TALL OIL AND METHOD FOR ITS MANUFACTURING

(75) Inventors: Ari Lindén, Raisio; Arto Tonttila, Pirkkala; Mika Tonttila, Pirkkala, all of (FI)

(73) Assignee: Voitelukeskus Tonitila Oy, Tampere (FI)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/142,380

(22) PCT Filed: Mar. 12, 1997

(86) PCT No.: PCT/FI97/00164

§ 371 (c)(1),
(2), (4) Date: Sep. 4, 1998

(87) PCT Pub. No.: WO97/33954

PCT Pub. Date: Sep. 18, 1997

(30) Foreign Application Priority Data

Mar. 12, 1996 (FI) ..... 961151
Oct. 3, 1996 (FI) ..... 963962

(51) Int. Cl.[7] ..... C09K 5/00
(52) U.S. Cl. ..... 252/76; 252/79; 508/485
(58) Field of Search ..... 508/485; 252/76, 252/79

(56) References Cited

U.S. PATENT DOCUMENTS

| | | | | |
|---|---|---|---|---|
| 3,620,290 A | * | 11/1971 | Kress et al. | 508/485 |
| 3,657,126 A | * | 4/1972 | Sawyer | 508/485 |
| 4,061,581 A | | 12/1977 | Leleu et al. | 252/32.7 |
| 4,589,990 A | * | 5/1986 | Zehler et al. | 508/485 |
| 5,866,520 A | * | 2/1999 | Addagarla et al. | 508/485 |

FOREIGN PATENT DOCUMENTS

| | | | |
|---|---|---|---|
| EP | 0 652 280 A2 | | 10/1995 |
| FI | 95367 | * | 10/1995 |
| GB | 1261025 | * | 1/1972 |
| WO | 96/07632 | * | 3/1996 |

* cited by examiner

*Primary Examiner*—Yogendra N. Gupta
*Assistant Examiner*—Derrick Hamlin
(74) *Attorney, Agent, or Firm*—Connolly Bove Lodge & Hutz, LLP

(57) ABSTRACT

Hydraulic oil including an ester of tall oil obtained with at least one polyvalent alcohol selected from the group consisting of a polyhydroxy compound of neopentane and poly(ethyleneglycol), an oxidation inhibitor, a corrosion inhibitor, an antifoam agent, and an EP lubricant.

4 Claims, 1 Drawing Sheet

HYDRAULIC OIL BASED ON ESTERS OF TALL OIL AND METHOD FOR ITS MANUFACTURING

FIELD OF THE INVENTION

The present invention relates to hydraulic oil and to a method for manufacturing hydraulic oil.

BACKGROUND OF THE INVENTION

Hydraulic oil refers to a fluid which is intended to transmit power or carry a load in various systems. Hydraulic oil is used in different stationary and mobile machines, such as cylinders performing a linear movement or rotating hydraulic motors.

In addition to power transmission, the function of hydraulic oil is to lubricate mobile parts in the components of the system and to cool the system.

Hydraulic oil has to fulfill the following requirements:

1. Suitable viscosity at different temperatures
2. Sufficient pressure endurance
3. Non-foaming properties
4. Oxidation inhibition
5. Corrosion inhibition
6. Inert quality In addition to these qualities, biodegradability has become more important in the past few years, particularly in hydraulic oils to be used in work machines moving outdoors.

Finnish Patent No. 95367 presents a method for manufacturing a synthetic ester from vegetable oil. This publication describes manufacturing of trimethylolpropane ester of rapeseed oil by transesterification starting from a mixture of lower alkyl esters of the fatty acids of rapeseed oil, obtained by transesterification of vegetable oil with lower alkanols. Finish Patent No. 95367 also describes manufacturing of methyl ester of tall oil, but this does not take place by transesterification reaction, and there is no description on the further processing or use of the methyl ester.

SUMMARY OF THE INVENTION

The object of the invention is to present a hydraulic oil whose raw material is amply available as an industrial by-product and which is biodegradable. The object of the invention is also to present a method for manufacturing such a hydraulic oil in a simple manner which does not require many reaction stages. The basic material of the hydraulic oil is a tall oil ester which is selected from the following substances or their mixtures:

- ester of a polyhydroxy compound of neopentane, such as
  - trimethylolpropane ester (TMP ester),
  - pentaerythritol ester,
  - trimethylolethane ester,
  - trimethylolbutane ester,
  - neopentyl glycol ester, and
- poly(ethyleneglycol) ester.

DETAILED DESCRIPTION OF THE INVENTION

It has been found that esterification of a di- or polyvalent alcohol containing at least five carbon atoms with tall oil gives a hydraulic oil having a viscosity in the suitable range and, after addition of certain additives, having also surprisingly good properties for a hydraulic oil. Further, the viscosity properties of the oil can be controlled by adding small amounts of some lower ester of tall oil, particularly its ethylene glycol ester. Lower esters refer to esters obtained with an alcohol being bivalent (dihydroxy) at most and having fewer carbon atoms than the polyols listed above, or being monovalent, wherein it can have more carbons in its carbon chain. This ester has by nature a lower viscosity than the above-listed polyol esters.

Figure 1:
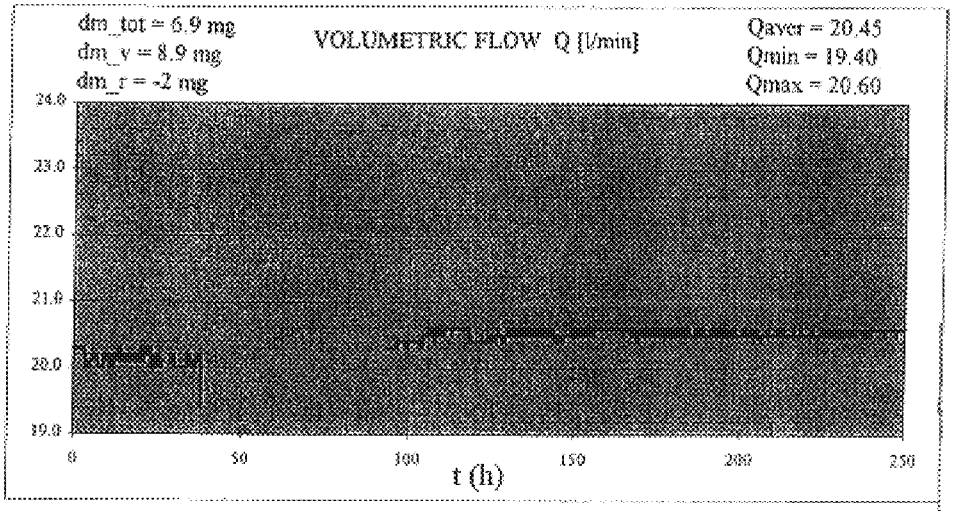
FIG. 1 is a graph representing volumetric flow during test runs of the composition of the present invention.
Figure 2:
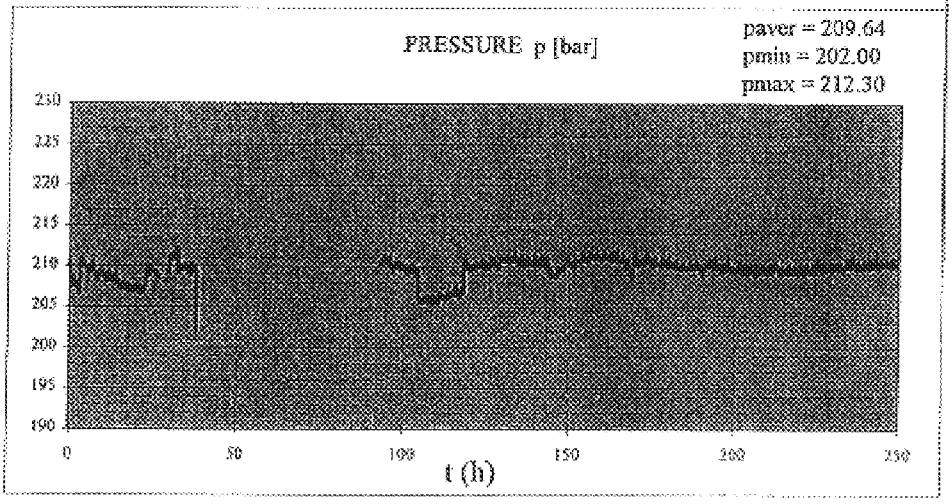
FIG. 2 is a graph representing pressures during test runs of the composition of the present invention.
Figure 3:
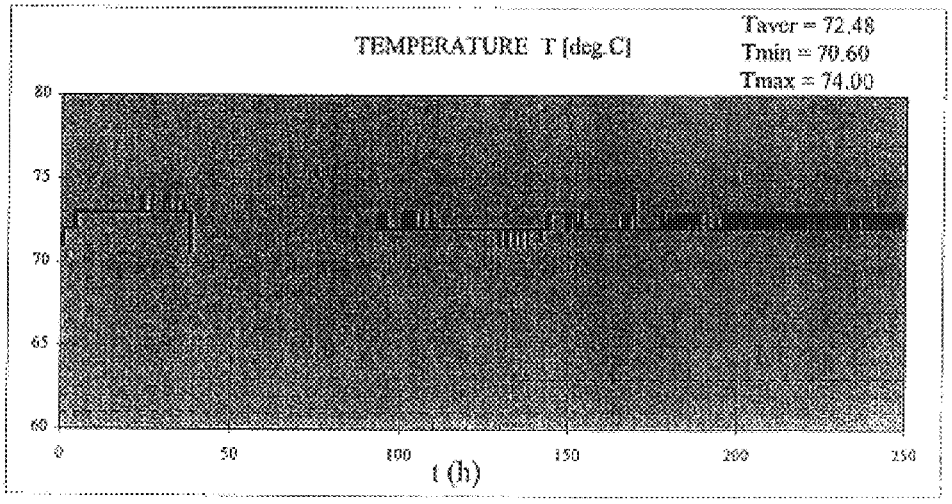
FIG. 3 is a graph representing temperatures during test runs of the compositions of the present invention.

The raw materials and composition of the invention will be described in detail in the following.

Tall oil is a by-product of sulphate cooking (kraft cooking) of cellulose, and it is obtained by distilling soap neutralized with an acid, the soap being created when resin and fatty acids are saponified. In a known manner, tall oil is composed of fatty acids, resin acids and unsaponifiable components, and the ratios, such as the quantity of different fatty acids, vary with the tree species and the distillation process. Typical compositions include 20 to 40% resin acids, 50 to 75% fatty acids and 3 to 15% unsaponifiable components. A high fatty acid content is aimed at in practice. The fatty acids of tall oil comprise typically mostly oleic acid and linoleic acid (totalling more than ¾), the rest being palmitic acid and stearic acid.

Tall oil is esterified with any of the abovementioned polyols comprising at least four carbon atoms in direct esterification reaction at a suitably high temperature. The bi- or polyvalent alcohol or polyol can be any of the abovementioned polyhydroxy compounds of neopentane containing at least five carbon atoms (trimethylolpropane, trimethylolethane, trimethylolbutane, that is, trimethylolalkanes in general, as well as pentaerythritol or neopentyl glycol), or poly-(ethyleneglycol) (PEG) which is a condensation polymer of ethylene glycol having at least four carbon atoms (dimer) in the carbon skeleton.

In the following, some esterification reactions of polyhydroxy compounds of neopentane with tall oil acids are described in an exemplary fashion. In the formula, T denotes different carbon skeletons of tall oil acids.

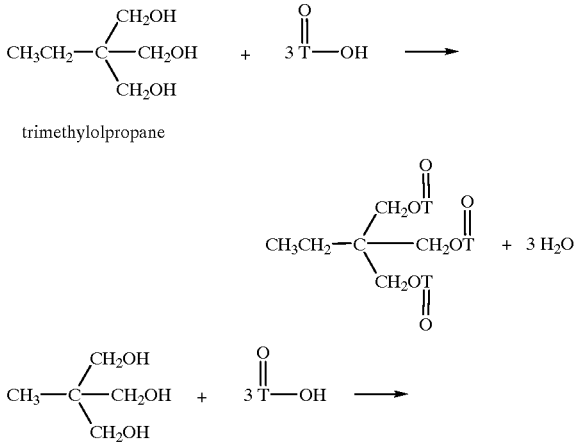

-continued

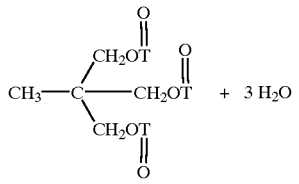

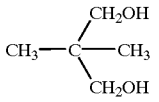

analogically neopentyl glycol

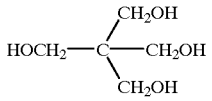

analogically pentaerythritol

It has been observed that the above-mentioned esters, particularly the polyhydroxy compounds of neopentane, show good water separation properties, i.e. in a way they "repell" water. This is especially useful in hydraulic oil application, which often involves the problem of water becoming dispersed in the oil.

Some typical basic agents of a hydraulic oil are presented below.

| POLYOL USED | VISCOSITY (mPas/25° C.) | VISCOSITY CLASS (ISO VG) |
|---|---|---|
| Pentaerythritol | 120 | 68 |
| PEG | 50 | 32 |
| PEG | 97 | 46 |
| Trimethylolpropane | 100 | 46 |

The chain length of polyethylene glycol (PEG) can be used to influence the viscosity values, and also a mixture containing chains of different lengths can be used. When poly(ethyleneglycol) is used, it may be necessary to add some demulsifier, because PEG has the tendency to form water-in-oil emulsions.

The properties can naturally be influenced by blending the above-mentioned esters in a suitable ratio. Further, the viscosity can be lowered by blending the above-mentioned basic material with lower esters of tall oil acids (tall oil ethylene glycol ester or tall oil esters with monovalent alcohols). However, most (more than 50 wt-%) of the ester quantity is always some of the above-listed (higher) esters.

The following table shows the analysis results of a typical tall oil ester that is used as the basic material for a hydraulic oil.

TABLE 1

Tall oil TMP ester, viscosity class ISO VG 46

| Analysis: | | Analysis method: |
|---|---|---|
| Acid number (mg KOH/g) | 1 | ASTM D 803-82 (1987) |
| Colour (Gardner) | 5 | ASTM D 1544-80 |
| Viscosity/40° C. (mPas) | 48 | Brookfield, spindle 21, speed 100 |

TABLE 1-continued

Tall oil TMP ester, viscosity class ISO VG 46

| Analysis: | | Analysis method: |
|---|---|---|
| Viscosity/100° C. (mPas) | 10 | Brookfield, spindle 21, speed 100 |
| Density (kg/dm$^3$) | 0.932 | SCAN-T 2:65 |
| Viscosity index | 194 | |
| Saponification number (mg KOH/g) | 182 | ASTM D 803-82 |
| Iodine number (cg $I_2$/g) | 135 | ASTM D 1959-85 |
| Cloud point (° C.) | −34 | ASTM D 2500 |

Adding to this TMP ester the additives 1 to 5 listed below resulted in a viscosity of 50.5 at 40° C. and 9.8 at 100° C., and in a viscosity index of 185.

The following table shows the analysis results of another basic material.

Table 2. Tall oil TMP ester blended with a small quantity of tall oil ethylene glycol ester, viscosity class ISO VG 46

TABLE 2

Tall oil TMP ester blended with a small quantity of tall oil ethylene glycol ester, viscosity class ISO VG 46

| Analysis | |
|---|---|
| Acid number (mg KOH/g) | 13.2 |
| Colour (Gardner) | 8.5 |
| Viscosity/40° C. | 40.9 (mPa.s) |
| Viscosity/100° C. | 9.42 (mPa.s) |
| Density/g/dm$^3$/40° C. | 912 |
| Density/g/dm$^3$/100° C. | 874 |
| Viscosity index | 234 |
| Pour-point (° C.) | −34° C. |

Blending TMP ester further with lower tall oil acid esters gives a viscosity class of 32.

The following additives are added to the above-mentioned basic materials to improve the properties:

| | | |
|---|---|---|
| 1. | Oxidation inhibitor RC 9308 | 2% |
| 2. | EP lubrication (boundary lubricant) Vanlube 672 | 1% |
| 3. | Copper corrosion inhibitor Irgamet 39 | 0.05% |
| 4. | Antifoam agent Bevaloid 311 M | 0.1% |
| 5. | Pour-point depressant Lubrizol 3123 | 0.15% |

It is clear that it is possible to use all commercially available additives known in the field, and to use them in different quantities. The oxidation inhibitor can also include a corrosion inhibitor. A pour-point depressant is not necessary, if the hydraulic oil is used in warm environment.

The oxidation inhibitor is important for the function of the hydraulic oil. The following table shows still results of tests on the oxidation resistance of tall oil TMP ester with an addition of the oxidation inhibitor Additin RC9308 to obtain a content of 1.5 wt-%.

Table 3. Oxidation resistance properties of tall oil TMP ester expressed as a change in oxygen pressure according to the standard ASTM D525.

TABLE 3

Oxidation resistance properties of tall oil TMP ester expressed as a change in oxygen pressure according to the standard ASTM D 525.

| Time/h | Start | 12 | 24 | 36 | 48 | 60 | 72 |
|---|---|---|---|---|---|---|---|
| Pressure/psi | 125 | 117 | 110 | 104 | 100 | 93 | 90 |

The hydraulic oil of the invention has a high viscosity index, and its biodegradability makes it excellent particularly in applications involving a risk of oil leaking into the environment.

We shall next discuss in more detail the additives which are added to the tall oil ester or mixture of esters to make the actual hydraulic oil.

1. Oxidation Inhibitor

An advantageous oxidation inhibitor for use is Additin® RC 9308 manufactured by Rhein Chemie Rheinau GmbH, Germany. This substance contains, besides the antioxidant, also a corrosion inhibitor. The substance contains ca. 1.5 wt-% of C12-C14-t-alkylamines (CAS number 68955-53-3), ca. 4 wt-% of tolyltriazol (CAS number 29385-43-1), and ca. 3.4 wt-% tributyl phosphate (CAS number 126-73-8). The RC 9308 content in the oil is advantageously more than 1.0 wt-%, preferably at least 1.5 wt-%. Other applicable agents are RC 7110 and RC 6301 by the same manufacturer. All the above-mentioned substances can be used also in a mixture, wherein the content of the mixture is advantageously also more than 1.0 wt-% in the oil, preferably at least 1.5 wt-%. Usable mixtures include RC 7110 +RC 9308 and RC 7110+RC 6301.

By blending RC 9308 to the TMP ester in an amount of 1.5 wt-%, an oxygen pressure test (ASTM D 525) gave a value 101 psi (72 h), whereas the value was 7 psi without additive.

2. EP Lubrication (Boundary Lubrication)

The boundary lublication additive is advantageously Vanlube® 672 (manufactured by R. T. Vanderbilt Company, Inc., USA), which is an EP (extreme pressure) and antiwear additive of the phosphate type, more precisely an amine phosphate. The substance is a viscose fluid with a density of 1.05 kg/l at 25° C. Blending Vanlube 672 to the TMP ester to make a 1.0 wt-% content in oil gave a value exceeding 12 in the FZG lubrication ability test which is very descriptive of EP lubrication. The other additives were Additin® RC 9308 (2,0 wt-%) and Irgamet 39 (0,05 wt-%). The Vanlube 672 content is advantageously more than 0.5 wt-%, preferably between 1.0 and 3.0 wt-%. Also other additives with a corresponding active agent content can be used.

3. Corrosion Inhibitor

As stated above, a corrosion inhibitor is already contained in the commercial oxidation inhibitor. In addition to this, as particular copper corrosion inhibitor (so-called yellow metals protection) is preferably used the agent Irgamet 39 manufactured by Ciba-Geigy AG. The substance is a tolutriazol derivative, and its sufficient content in a hydraulic oil is 0.02 to 0.05 wt-%.

4. Antifoam Agent

An advantageous antifoam agent to be used is Bevaloid 311 M manufactured by Rhone-Poulenc Chemicals (dispersion of non-polar surface active agents in paraffin oil, specific weight ca. 0.79 at 20° C.). The recommendable quantity is about 0.1 wt-%, but it may vary from 0.05 to 0.2 wt-%.

5. Pour-Point Depressant

A pour-point depressant is used, if it is expected that the hydraulic oil will be used at low temperatures. A suitable agent is Lubrizol 3123 (by Lubrizol Petroleum Chemicals Company, Ohio, USA). The suitable content is ca. 0.05 to 0.5 wt-%, usually ca. 0.1 to 0.2 wt-%.

We shall now describe tests made with an advantageous composition for the properties required particularly of a hydraulic oil. Reference will be made to the appended drawing showing the graph of conditions during the test runs. The oil is based on tall oil trimethylolpropane ester (TMP) supplied by Forchem Oy, Oulu. The properties of the raw material were as follows:

| Viscosity (mPas) | |
|---|---|
| 25° C.: | 100 |
| 40° C.: | 48 |
| 100° C.: | 11 |
| ISO VG: | 46 |
| Acid number: less than 10 mg KOH/g | |
| Iodine number: 135 $gI_2$/100 g | |
| Specific weight: 0.91 (40° C.) | |

The raw material was provided with additives as follows (values wt-%):

| | | |
|---|---|---|
| 1. | Oxidation inhibitor Additin RC 9308 | 2% |
| 2. | EP lubrication (boundary lubrication) Vanlube 672 | 1% |
| 3. | Copper corrosion inhibitor Irgamet 39 | 0.05% |
| 4. | Antifoam agent Bevaloid 311 M | 0.1% |
| 5. | Pour-point depressant Lubrizol 3123 | 0.15% |

Results of Wear Test According to DIN 51389 and ASTM 2882 with Hydraulic Oil

The test arrangements corresponded to the above-mentioned standards with the exception that a Vickers 20VQ pump was used instead of Vickers V104. This resulted in higher pressure level used in the test.

| Test conditions achieved | | |
|---|---|---|
| A. | Pressure | 210 ± 10 bar (3000 psi) |
| B. | Temperature | 69 −2/+7° C. |
| C. | Viscosity | ca. 20 cSt |
| D. | Volume flow rate | 20 ± 1 l/min |
| E. | Duration | 250 h |

The test results were as follows:

| | | | |
|---|---|---|---|
| Ring mass | (0 h) | [g] | 405.836 |
| Vane mass | (0 h) | [g] | 54.1540 |
| Ring mass | (250 h) | [g] | 405.838 |
| Vane mass | (250 h) | [g] | 54.1451 |
| Ring wear | | [mg] | −2.0 |
| Vane wear | | [mg] | 8.9 |
| Total wear | | [mg] | 6.9 |

The test showed the examined test batch to have good quality. DIN 51.525 Teil 2 gives for pass limits in V104 test 30 mg for vanes and 120 mg for ring. In view of the oils tested so far, the given limits are rather too strict than slack. The water content of the test batch was 400 ppm at the start and 210 ppm after the test.

The test results are slightly improved by the fact that the ring could not be made completely clean with the solvents used. This will have a maximum effect of few milligrams on the results.

Use Tests

The same hydraulic oil has been used in a forest work machine, time of use 1968 h total. The test conducted with the oil after the use gave the following results:

| | | |
|---|---|---|
| Viscosity 40° C. | 33.54 cSt | (ASTM D 445) |
| Viscosity 100° C. | 7.347 cSt | (ASTM D 445) |
| Viscosity index | 194 | (ASTM D 2270) |
| Water content | 0.08 wt-% | (ASTM D 1744) |
| Acid number, TAN | 10.4 mg KOH/t | (ASTM D 644) |

Pentaerythritol Ester of Tall Oil

A four-ball test was conducted with a tall oil pentaerythritol ester with no additives, applying the method ASTM D 4172 (1 h test with constant load). The load was 400 N and the temperature 20° C. Diameter of the wear mark in 1 hour test was 1.2 mm.

Due to the similarity of the other esters mentioned above, substances made by adding additives to them are also very well applicable as fluids transmitting power or carrying a load in hydraulic systems.

What is claimed is:

1. A method for manufacturing and using hydraulic oil, the method comprising:

providing tall oil comprising tall oil acids;

directly esterifying said tall oil with at least one polyvalent alcohol selected from the group consisting of a polyhydroxy compound of neopentane and poly (ethyleneglycol);

mixing the esterified tall oil additives wherein said additives comprise an oxidation inhibitor, a corrosion inhibitor, an antifoam agent, and an EP lubricant; and using the esterified tall oil additive mixture as a hydraulic oil in process where it is subjected to pressure and where it transmits power or carries a load.

2. The method according to claim 1, wherein said polyhydroxy compound of neopentane is selected from the group consisting of trimethylopropane, pentaerythritol, trimethylolethane, trimethylol butane, and neopentyl glycol.

3. The method according to claim 1, wherein said process is a forest work machine.

4. The method according to claim 2, wherein said process is a forest work machine.

* * * * *